US011180965B2

(12) United States Patent
Zhao et al.

(10) Patent No.: US 11,180,965 B2
(45) Date of Patent: Nov. 23, 2021

(54) AUTONOMOUS THROUGH-TUBULAR DOWNHOLE SHUTTLE

(71) Applicant: China Petroleum & Chemical Corporation, Beijing (CN)

(72) Inventors: Jinhai Zhao, Houston, TX (US); Sheng Zhan, Houston, TX (US); Jun Han, Houston, TX (US)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 295 days.

(21) Appl. No.: 16/440,739

(22) Filed: Jun. 13, 2019

(65) Prior Publication Data

US 2020/0392803 A1 Dec. 17, 2020

(51) Int. Cl.

| | |
|---|---|
| ***E21B 23/00*** | (2006.01) |
| ***E21B 47/00*** | (2012.01) |
| ***E21B 47/12*** | (2012.01) |
| ***E21B 49/00*** | (2006.01) |
| *E21B 41/00* | (2006.01) |

(52) U.S. Cl.

CPC ..... *E21B 23/00* (2013.01); *E21B 47/00* (2013.01); *E21B 47/12* (2013.01); *E21B 49/00* (2013.01); *E21B 23/001* (2020.05); *E21B 41/0085* (2013.01)

(58) Field of Classification Search

CPC ..... E21B 23/00; E21B 41/0085; E21B 47/00; E21B 47/12; E21B 49/00; E21B 2023/008; E21B 23/001

See application file for complete search history.

(56) References Cited

U.S. PATENT DOCUMENTS

| | | | | |
|---|---|---|---|---|
| 3,260,112 A * | 7/1966 | Godbey | G01K 11/06 374/104 |
| 4,676,310 A * | 6/1987 | Scherbatskoy | E21B 47/00 340/853.4 |
| 5,259,452 A * | 11/1993 | Wittrisch | E21B 23/01 166/250.01 |
| 5,967,816 A | 10/1999 | Sampa et al. | |
| 6,234,257 B1 * | 5/2001 | Ciglenec | E21B 49/00 175/50 |
| 6,360,823 B1 * | 3/2002 | Ranson | E21B 23/00 166/381 |

(Continued)

FOREIGN PATENT DOCUMENTS

WO 2016055408 A1 4/2016

OTHER PUBLICATIONS

Mark A. Andersen, "The Defining Series: Introduction to Wireline Logging", Oilfield Review, Spring 2011, vol. 23, No 1.

*Primary Examiner* — Daniel P Stephenson

(74) *Attorney, Agent, or Firm* — Novick, Kim & Lee, PLLC; Allen Xue

(57) ABSTRACT

An apparatus for traveling between an earth surface and a wellbore in an earth formation contains an instrument sub, a thruster for generating a motive force, and a power source that provides power to the instrument sub and the thruster. The instrument sub contains well logging instruments. The instrument sub, the thruster, and the power source are connected to form or are disposed in a substantially tubular body. The apparatus further contains a buoyance-generating device.

16 Claims, 2 Drawing Sheets

(56) References Cited

U.S. PATENT DOCUMENTS

| | | | | |
|---|---|---|---|---|
| 6,443,228 | B1 * | 9/2002 | Aronstam | E21B 47/01 166/250.11 |
| 6,971,265 | B1 * | 12/2005 | Sheppard | E21B 47/017 73/152.54 |
| 6,976,535 | B2 * | 12/2005 | Aronstam | E21B 47/01 166/250.11 |
| 7,219,725 | B2 * | 5/2007 | Chisholm | E21B 43/121 166/107 |
| 7,385,523 | B2 * | 6/2008 | Thomeer | E21B 47/12 340/854.8 |
| 7,438,125 | B2 * | 10/2008 | Victor | E21B 43/127 166/105.2 |
| 8,171,989 | B2 * | 5/2012 | Goode | E21B 47/00 166/250.01 |
| 9,470,073 | B2 * | 10/2016 | Xiao | E21B 43/121 |
| 9,482,781 | B2 * | 11/2016 | Kamal | H02J 7/0042 |
| 9,528,354 | B2 * | 12/2016 | Loiseau | E21B 43/119 |
| 9,546,544 | B2 * | 1/2017 | Al-Badran | E21B 47/00 |
| 9,650,851 | B2 * | 5/2017 | Whitsitt | E21B 47/092 |
| 10,047,605 | B2 * | 8/2018 | Zahlsen | E21B 49/081 |
| 10,267,144 | B2 * | 4/2019 | Hazel | E21B 47/01 |
| 2004/0168828 | A1 * | 9/2004 | Mock | E21B 4/18 175/51 |
| 2016/0059939 | A1 * | 3/2016 | Lamonby | E21B 41/00 114/337 |
| 2018/0021945 | A1 | 1/2018 | Pettersen et al. | |
| 2020/0392803 | A1 * | 12/2020 | Zhao | E21B 23/00 |

* cited by examiner

AUTONOMOUS THROUGH-TUBULAR DOWNHOLE SHUTTLE

FIELD OF TECHNOLOGY

The present disclosure relates generally to downhole tools in drilling operations, and particularly to apparatus and methods for transporting tools between the earth surface and bottomhole.

BACKGROUND

Drilling operations in gas and oil exploration involve driving a drill bit into the ground to create a borehole (i.e., a wellbore) to extract oil and/or gas from a pay zone. The drill bit is installed at the distal end of a drill string, which extends from a derrick on the surface into the borehole. The drill string is formed by connected a series of drill pipes together. A bottom hole assembly (BHA) is installed proximately above the drill bit in the drill string.

The BHA contains instruments that collect and/or transmit sensor data regarding the drilling tools, wellbore conditions, earth formation, etc. to the surface. Such information is used to determine drilling conditions including drift of the drill bit, inclination and azimuth, which in turn are used to calculate the trajectory of the borehole. Some of the data are transmitted real-time uphole to the surface using the telemetry technology. Real-time data are crucial in monitoring and controlling the drilling operation, especially in directional drilling.

Modern telemetry technologies include mud pulse telemetry, electromagnet telemetry, acoustic telemetry, and wired drill pipe telemetry. Mud pulse telemetry uses modulated mud pulses to carry data uphole. It has a low data transmission rate, which may be insufficient to transmit data real-time to the surface. As such, only critical data are transmitted in real time while a large portion are stored locally in a memory stalled in the BHA. In wired drill pipe telemetry, each drill pipe has a communication cable embedded inside. When a series of drill pipes are connected together, sections of communication cable form a continuous communication cable from the BHA to the surface along the drill string. The advantage of the wired telemetry is that the data transmission through the cable is bidirectional and is also much faster than that of mud pulse telemetry. However, connecting two sections of communication cable at the joint between two drill pipes requires sophisticated and expensive coupling devices. Deeper the borehole is, more numerous of such joints there are. Breakage of the communication cable at any of the joints would disable the telemetry, which requires expensive repairs. Electromagnetic telemetry and acoustic telemetry are both limited by signal attenuation, especially in deep wells.

Wireline logging are widely employed to investigate the earth formation. A sonde (i.e., a logging tool) tethered with a wireline is first lowered into the borehole and reeled along the drill string back to the surface. The sonde contains sensors that measure the properties such as resistivity, conductivity, formation pressure, sonic properties, as well as wellbore dimension. However, in horizontal and deviated drilling, the sonde cannot be lowered by gravity alone and requires to be pushed or otherwise carried down to the bottom hole.

Accordingly, there are pressing needs for tools and methods for transporting tools and data between the earth surface and bottomhole.

SUMMARY

The present disclosure provides apparatus for traveling between an earth surface and a wellbore in an earth formation via a drill string. The apparatus contains an instrument sub, a thruster for generating a motive force and a power source that provides power to the instrument sub and the thruster. The apparatus may be in a substantially tubular shape. The instrument sub, the thruster, and the power source are connected to form a tubular body or are disposed in a tubular body. The apparatus further contains a buoyance-generating device.

The instrument sub contains a plurality of instruments for measuring properties of the earth formation or in a wellbore. It also contains non-volatile memory, microcontroller, and interface that wirelessly communicates with instruments in the BHA in the wellbore.

The buoyance-generating device provides a variable buoyancy. The buoyance-generating device has a ballast tank and a compressed air source. Fluid in the ballast tank is expelled from the ballast tank using the compressed air to increase buoyancy.

The apparatus may also have a plurality of free rolling wheels mounted about a surface of the tubular body. It can either be tethered using a wireline or autonomous. The wireline supplies power to the apparatus and transmits data to and from the apparatus.

This disclosure further provides a method for transporting the apparatus between an earth surface and a wellbore via a drill string. In this method, the apparatus enters the drill string through an inlet, e.g., a drill pipe, at the earth surface. A drilling fluid, driving by a mud pump, is circulated through the wellbore so that the apparatus moves downhole with the drilling fluid via the drill string to a position above the BHA. When the mud pump is turned off and the circulation of the drilling fluid stops, the apparatus returns to the earth surface through the drill string.

In one embodiment of the method, the apparatus is brought back to the surface by the buoyancy force generated by the buoyance-generating device. Such a buoyance-generating device may be a hollow cylinder or contains a ballast tank filled with a liquid. The apparatus may also be brought back to the surface by activating the thruster in the apparatus to generate a upward motive force.

This disclosure further provides a method for transmitting data from a wellbore using the apparatus. The apparatus is first lowered through a drill string down the wellbore. The instrument sub in the apparatus collects data in the wellbore and returns to the surface afterwards. The instrument sub has a plurality of sensors that collect data concerning properties of an earth formation surrounding the wellbore.

In some embodiments, the apparatus is connected to a data acquiring system on a earth surface through a wireline and transmits the data to the data acquiring system through the wireline. The instrument sub comprises a receiver for receiving signals from a transmitter installed in the BHA.

In still some embodiments, the apparatus is used for wireline well logging. The apparatus is tethered to a wireline and lowed into an open wellbore that does not have the drill string. When logging is done, the apparatus is retrieved back to the surface by both pulling wireline and activating the buoyancy generating device or the thruster, which facilitates the retrieval especially through the horizontal well section.

DESCRIPTION OF THE DRAWINGS

For a more complete understanding of the embodiments described in this disclosure, reference is made to the following detailed description taken in conjunction with the accompanying drawings, in which.

DETAILED DESCRITPION

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the disclosure described herein.

Figure 1:
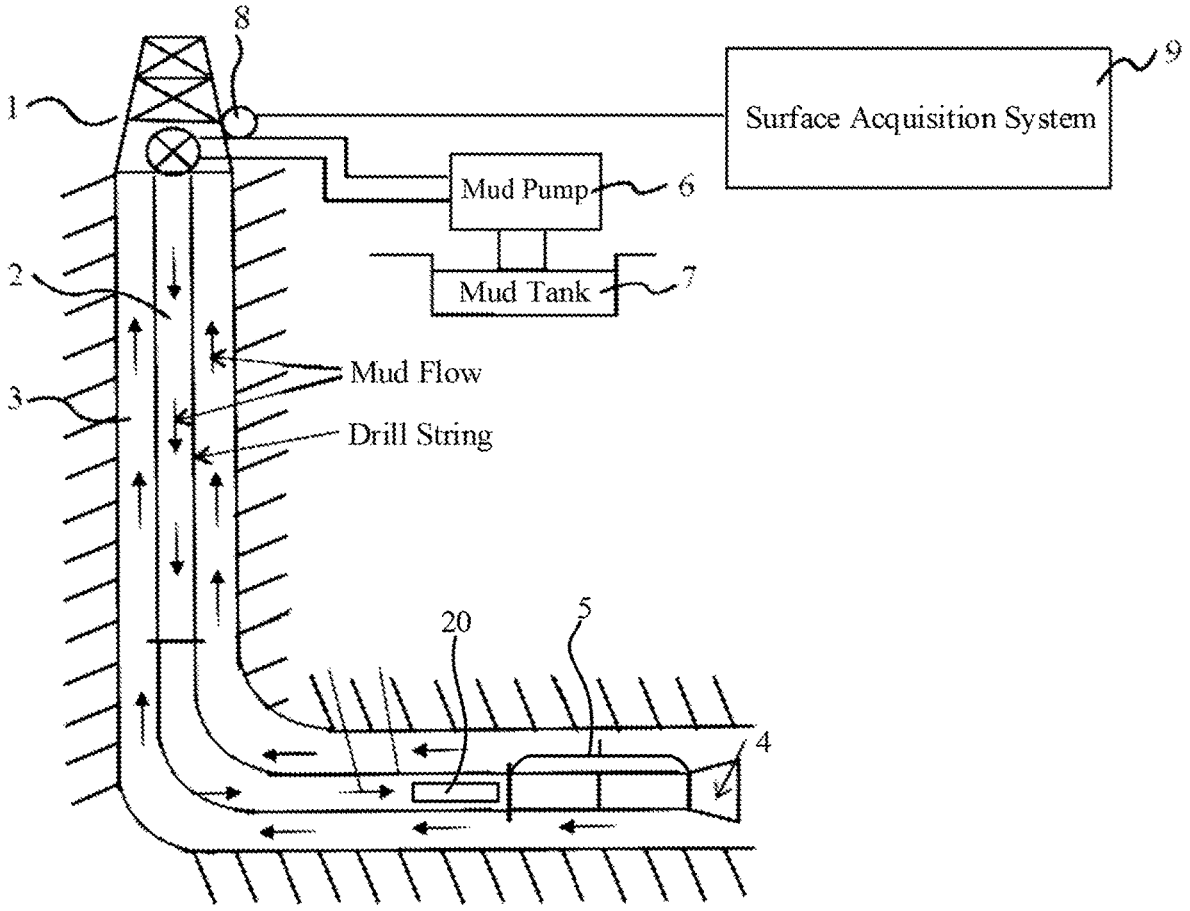
FIG. 1 is a schematic illustration of a drilling rig of the current disclosure.

FIG. 1 schematically illustrates a drilling system. The drill string 2 extends from the derrick 1 on the earth surface into the borehole 3. The drill bit 4 is installed at the distal end of the drill string 2. The BHA 5 is installed above the drill bit 4. The mud pump 6 pumps the drilling mud from the mud tank 7 downhole through the drill string 1. The mud flow circulates back to the mud tank 7 through the annulus between the drill string 2 and the borehole 3.

The detailed structure of the BHA 5 is not shown in FIG. 1. In one embodiment of this disclosure, the BHA 5 contains a mud pulser, a mud motor, a measurement-while-drilling (MWD) instruments, and logging-while-drilling (LWD) instruments. In this disclosure, the MWD instruments and LWD instruments are collectively referred to as the MWD tool. The MWD tool can be powered by a mud motor, a battery, or both the mud motor and the battery (not shown). The MWD tool has one or more internal memory, a microprocessor, software and/or firmware with pre-programed instructions installed in the memory, and input/output communication ports for communications with other tools in the BHA, e.g., a mud pulser. The firmware controls the operation of the MWD tool, e.g., the operation of the sensors and telemetry instruments.

The drilling system also includes a plurality of sensors. A pressure sensor 8 is installed in the passage of the mud flow at the surface. The surface data acquisition system 9 acquires data using one or more telemetry methods, e.g., mud pulse telemetry, wired drill pipe telemetry, electromagnetic telemetry, acoustic telemetry.

In one of the embodiments in the current disclosure, as shown in FIG. 1, the borehole 3 has a substantially vertical section and a substantially horizontal section connected together via a curvilinear section. A downhole shuttle 20 is shown disposed in the wellbore, residing inside the drill string above the BHA 5.

Figure 2:
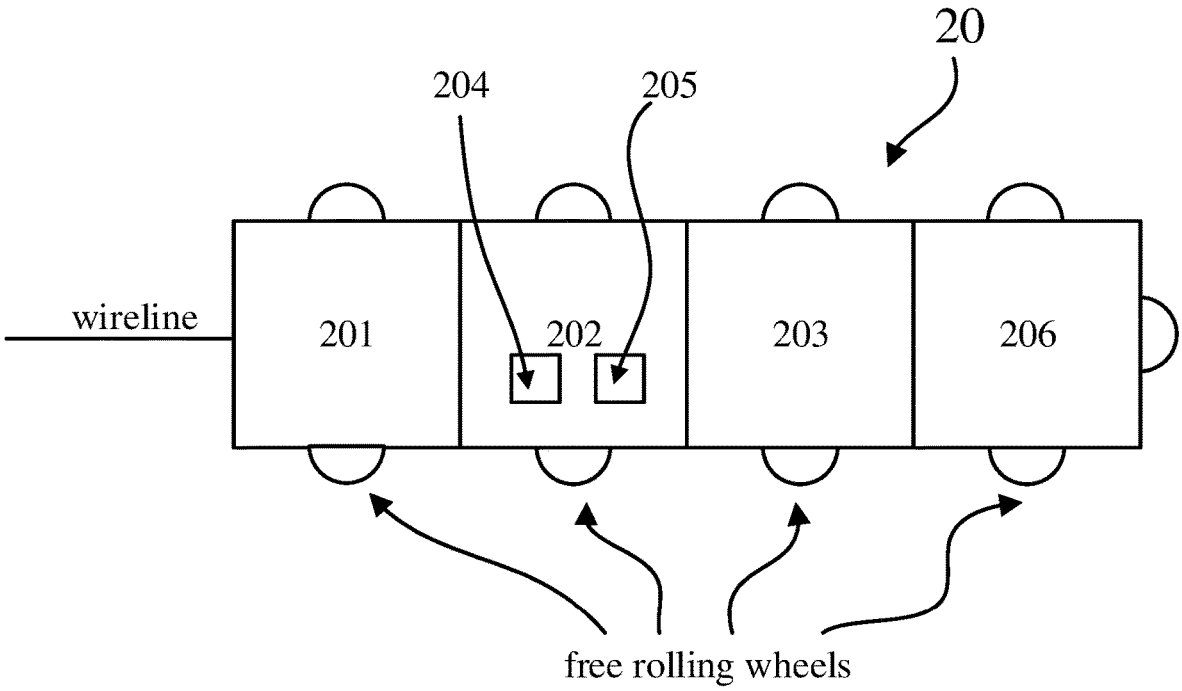
FIG. 2 is a schematic illustration of an exemplary downhole shuttle of the current disclosure.

FIG. 2 shows an embodiment of the downhole shuttle 20 of the current disclosure. It has a thruster module 201, which contains a thruster that provides a motive force to drive the shuttle to move about the drill string or to stabilize the shuttle inside the drill string when needed. The thruster can be a propeller, a impeller, a rotatable thruster, a retractable thruster, etc. In some embodiments, the thruster can change the direction of the motive force it generates, e.g., to push the shuttle uphole, downhole, or sideway. For example, the thruster has controllable-pitch propellers that can be reversed to generate thrust in reverse directions. Alternatively, the thruster can be mounted on a rotatable axis that can rotate to change the direction of the thruster.

In this embodiment, the downhole shuttle 20 also includes the instrument sub 203. The instrument sub 203 contains instruments that measure borehole conditions as well as the properties of the earth formation surrounding the wellbore, also referred to as well logging tools. Such well-logging tools measure formation properties including natural gamma ray emission, density, porosity, borehole caliper, resistivity, sonic property, etc.

The downhole shuttle 20 further contains a power module 202, which contains a power source 205 (e.g., a battery), as well as an electronics module 204 that performs functions such as controlling the shuttle 20 (e.g., using microcontroller), storing data, software, and/or firmware (e.g., in one or more non-volatile memory), and providing communication ports that connect to the instrument sub 203 (COM, Bluetooth, USB, etc.).

In some embodiments, the battery 205 in the power module 202 is rechargeable. The thruster in the thruster module 201 can generate power in the mud flow. For example, the propeller is connected to an electric motor. When the electric motor is not activated to drive the propeller, e.g., when the thruster is moving downhole with the mud flow or is stopped at the bottom, the mud flow rotates the propeller to reverse the electric motor, which generates power to charge the battery.

The electronics module 204 may also include circuitry and devices to accomplish wired or wireless communications with the data acquiring system 9 on the surface. The wired communication can be through a wireline (not shown) that connects the shuttle 20 and a surface equipment, e.g., the data acquiring system 9. The electronics module 204 may still include devices for wired or wireless communication with the BHA, e.g., a receiver that couples with a transmitter in the BHA to receive data from the BHA and to save the data in memory in the electronics module 204. The saved data can be retrieved after the shuttle 20 returns to the surface.

The electronics module 204 may further include a control circuitry that controls the movement of the shuttle. E.g., accelerometers in the control circuitry determines whether the shuttle is moving or not.

In the embodiment of FIG. 2, the electronics module 204 is a part of the power module 202 in a same drill collar. In other embodiments, the electronics module 204 can be installed in a different drill collar either by itself or with other instruments (e.g., the instrument sub 203).

The shuttle 20 also contains a buoyancy-generating device 206 that generates a buoyancy force that lifts the shuttle 20 upward. The buoyancy-generating device 206 may be simple, e.g., one or more hollow cylinders. It can also be more sophisticated. For example, the buoyancy-generating device 206 may contain a mechanism to adjust buoyancy in a controllable manner. It may include a ballast tank and a source of compressed air. When a higher buoyancy is required, the compressed air is injected into the ballast tank to replace the liquid inside the ballast tank and to increase buoyancy.

The thruster module 201, the power module 202, the instrument sub 203, the buoyancy-generating device 206 may be installed in one or more tubular housings, e.g., one or more drill collars. For example, the thruster 201 may be installed in an annular housing. The instrument sub 203, the power module 202, and the buoyancy-generating device 206 may be installed in their respective drill collars.

The shuttle optionally contains a tool module 207, which carries out certain workover such as well clean-up, setting plugs, etc. For example, the tool module 207 can be a robotic arm that performs functions such as opening or closing valves, retrieving small objects. For example, the robotic arm may retrieve certain instruments from the BHA, e.g., a releasable instrument sub installed inside the BHA.

The arrangement of components in the shuttle 20 is not limited to the embodiment shown in FIG. 2. The modules can be connected in different orders. For example, the thruster module 201 can be arranged at one or both ends of the shuttle. The buoyancy-generating 206 can be located at one end or in the middle of the shuttle.

In some embodiments, the tubular housings are axially connected together to form a substantially rigid, unitary tubular body. The connections between two adjacent tubular housings can use any known fastener, e.g., bolts, or by welding. In other embodiments, some or all of the tubular housings or modules are connected via flexible joints, e.g., a chain, an adjustable articulated joint, a latch, etc.

In still other embodiments, the tubular housing are equipped with a plurality of free-rolling wheels or fins to reduce friction between the tubular housing and the drill pipe. Two or more, preferably four or more, wheels or fins can be installed along a circumference of the outer wall of the tubular body at one or more points along its axial direction.

In still some embodiments, the tubular housing has a diameter that is smaller than the inner diameter of the drill pipe by, e.g., ½", 1", or 2", so that the tubular housing can move along the drill pipe relatively freely. In other embodiment, the tubular body, which is a unitary rigid tubular structure or contains multiple tubular housings or modules, has a total length that is smaller than the radius of the curvilinear section of the drill string. The total length can be from less than 1 meter up to several meters.

In further embodiments, the shuttle can be tethered with a wireline. The wireline may contain a power cable that supply power to the shuttle, a communication cable for sending data to and retrieving data from the shuttle, and/or a retaining cable to control the movement of the shuttle. In this embodiment, the shuttle may not need the buoyancy-generating device or the thruster as it can be retrieved by pulling the retaining cable. Alternatively, the shuttle may still have the buoyancy-generating device or the thruster and use one or both in addition to the retaining cable when retrieving the shuttle to the surface.

The some specific embodiments, the wireline for the tethered shuttle enters the drill string through a specially designed drill pipe, which has an opening on the sidewall that allows the wireline to pass. The shuttle is placed in the special drill pipe on the surface, with the wireline attached to it. The special drill pipe is lowered into the wellbore with the wireline extending out from its side. The wireline can be released or retrieved using a pulley on the surface.

This disclosure also provides methods for transmitting data from a wellbore using the downhole shuttle 20. In one embodiment, the downhole shuttle is first placed inside a drill pipe at the surface. The mud pump is turned on to create a downward flow inside the drill pipe to carry the shuttle to the bottomhole. In this mode, the shuttle may be passive (i.e., not powered on) so that it is carried by the mud flow downhole. Alternatively, the thruster in the shuttle may be turned on to facilitate the downward movement.

In this mode, certain thrusters (e.g., propeller turbine) can be used to generate power to charge the battery. If necessary, the thruster may be reversed to create an upward movement so that the shuttle can be stabilized at certain locations along the wellbore or slow down the downward movement so that the instruments in the shuttle may take proper measurements at these certain locations. In some other embodiments, when a tethered shuttle is used, the shuttle can be stopped at any point along the wellbore by adjusting the length of the wireline.

In some methods of the current disclosure, the shuttle has well logging tools installed in the instrument sub. The well logging tools make measurements along the wellbore. In other methods, the shuttle can be lowered to the proximity of the BHA, e.g., right above the BHA. The instrument sub in the shuttle can communicate with the BHA to accomplish short distance wireless transmission via, e.g., Bluetooth or electromagnetic transmission. The shuttle can download data from one or more memory equipped locally in the BHA. In addition to avoiding a tripping operation, that short distance wireless transmission does not suffer signal loss and other interferences to the extent that the long distance transmission experiences so the data reliability can be improved.

Once the shuttle completes its mission downhole, the operator may shut off the mud pump so the mud flow stops flowing. As such, the shuttle is lifted by the buoyancy-generating device upward along the drill string to the surface. However, in certain sections of the drill string, e.g., deviated or horizontal sections, the buoyancy-generating device cannot carry the shuttle uphole and the thruster is turned on to push or pull the shuttle in these sections.

The ON or Off state of the thruster can be determined by several methods. For example, accelerometers in the control circuitry in the electronics module 204 are used to determine whether the shuttle is moving or is stopped. If the shuttle is stopped or moving too slowly, the control circuitry is programed to turn on the thruster to move the shuttle along the drill string.

While in the foregoing specification this disclosure has been described in relation to certain preferred embodiments thereof, and many details have been set forth for purpose of illustration, it will be apparent to those skilled in the art that the disclosure is susceptible to alteration and that certain other details described herein can vary considerably without departing from the basic principles of the disclosure. In addition, it should be appreciated that structural features or method steps shown or described in any one embodiment herein can be used in other embodiments as well.

What is claimed is:

1. An apparatus for traveling between an earth surface and a wellbore in an earth formation via a drill string, comprising:

an instrument sub;

a thruster for generating a motive force;

a power source that provides power to the instrument sub and the thruster, wherein the instrument sub, the thruster, and the power source are connected to form or are disposed in a substantially tubular body, and wherein the apparatus has a wireline attached thereto, and the wireline supplies power to the apparatus and transmits data between the apparatus and a surface instrument.

2. The apparatus of claim 1, further comprises a buoyance-generating device.

3. The apparatus of claim 2, wherein the buoyance-generating device provides a variable buoyancy.

4. The apparatus of claim 3, wherein the buoyance-generating device comprises a ballast tank and a compressed air source, wherein a fluid in the ballast tank is expelled from the ballast tank using the compressed air to increase buoyancy.

5. The apparatus of claim 2, wherein the tubular body is a rigid, unitary structure.

6. The apparatus of claim 2, wherein one or more of the instrument sub, the tubular body has one or more sections connected via one or more articulated joints.

7. The apparatus of claim 2, further comprising a plurality of free rolling wheels mounted about a surface of the tubular body.

8. The apparatus of claim 1, wherein the instrument sub comprises a plurality of instruments for measuring properties of the earth formation or a condition in the wellbore.

9. The apparatus of claim 1, wherein the instrument sub contains a non-volatile memory, a microcontroller, and an interface that wirelessly communicates with instruments in a bottom hole assembly in the wellbore.

10. The apparatus of claim 1, wherein the thruster is a propeller or an impeller.

11. A method for transporting the apparatus of claim 1 between an earth surface and a wellbore via a drill string, comprising:

attaching the apparatus to the surface instrument via the wireline;

positioning the apparatus at an inlet of the drill string at the earth surface;

circulating a drilling fluid through the wellbore so that the apparatus moves downhole with the drilling fluid via the drill string to a position above a bottom hole assembly; and stopping the circulation of the drilling fluid to return the apparatus to the earth surface via the drill string.

12. The method of claim 11, further comprising: filling a ballast tank in the buoyancy-generating device with air to generate a buoyancy force.

13. The method of claim 12, further comprising: activating the thruster in the apparatus to generate a motive force.

14. A method for transmitting data from a wellbore using the apparatus of claim 1, comprising:

lowering the apparatus through a drill string down the wellbore;

collecting data using the instrument sub in the apparatus;

transmitting the collected data to a data acquiring system through the wireline; and returning the apparatus to an earth surface.

15. The method of claim 14, wherein the instrument sub comprises a plurality of sensors that collect data concerning properties of an earth formation surrounding the wellbore.

16. The method of claim 14, wherein the instrument sub comprises a receiver for receiving signals from a transmitter installed in the BHA.

* * * * *